United States Patent [19]

White, Jr.

[11] Patent Number: 4,474,544

[45] Date of Patent: Oct. 2, 1984

[54] ROTARY GEROTOR HYDRAULIC DEVICE WITH FLUID CONTROL PASSAGEWAYS THROUGH THE ROTOR

[76] Inventor: Hollis N. White, Jr., 243 Pyle La., Hopkinsville, Ky. 42240

[21] Appl. No.: 360,832

[22] Filed: Mar. 23, 1982

Related U.S. Application Data

[63] Continuation-in-part of Ser. No. 113,400, Jan. 18, 1980, Pat. No. 4,357,133, which is a continuation of Ser. No. 910,075, May 26, 1978, abandoned.

[51] Int. Cl.³ ..... F03C 3/00

[52] U.S. Cl. ..... 418/61 B; 418/186

[58] Field of Search ..... 418/61 B, 186–188

[56] References Cited

U.S. PATENT DOCUMENTS

| | | | |
|---|---|---|---|
| 211,769 | 1/1879 | Nash | 418/61 B |
| 3,270,683 | 9/1966 | McDermott | 418/61 B |
| 3,289,542 | 12/1966 | Fikse | 418/61 B |
| 3,876,343 | 4/1975 | Giversen | 418/186 |
| 4,219,313 | 8/1980 | Miller | 418/61 B |

*Primary Examiner*—William R. Cline
*Assistant Examiner*—J. McGlew
*Attorney, Agent, or Firm*—Woodling, Krost & Rust

[57] ABSTRACT

A rotary fluid pressure device is disclosed comprising a housing having fluid inlet and outlet means and enclosing a gerotor having an internally toothed member and a coacting externally toothed member having a less number of teeth than the internally toothed member and having its axis positioned eccentrically relative to the axis of the internally toothed member. A wobble stick in the housing has a first end connected to the axial drive shaft and a second end connected to the gerotor member having the orbital movement. The housing has one set of passageways communicating at all times with the expanding and contracting gerotor cells. The gerotor member having orbital movement is, in addition to its usual function, a valve with two travel passageways, one travel passageway coaxially surrounding the other passageway. These two travel passageways communicate at all times part of the set of passageways in the housing with only one fluid inlet or outlet while communicating other of this same set of passageways with the other fluid inlet and outlet.

A star-pointed annulus increases commutation fluid flow.

A laminated place design facilitates the construction of the porting passages.

9 Claims, 35 Drawing Figures

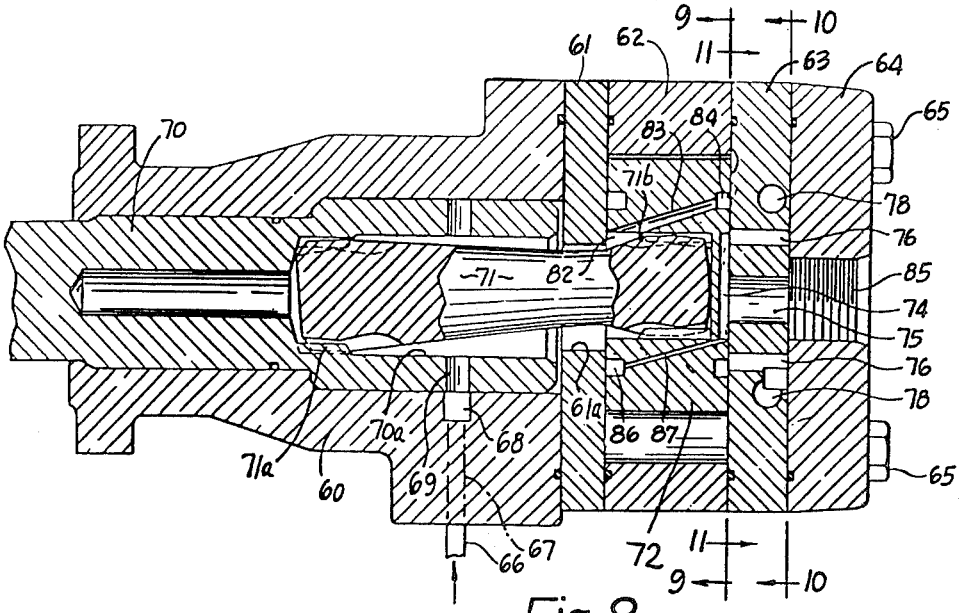
Fig. 8
Fig. 9
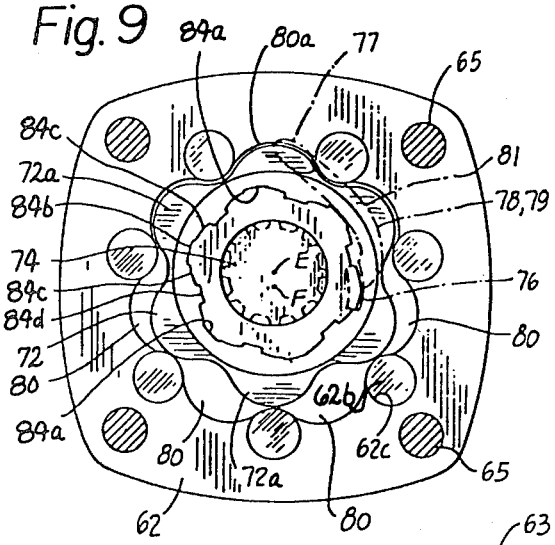
Fig. 10
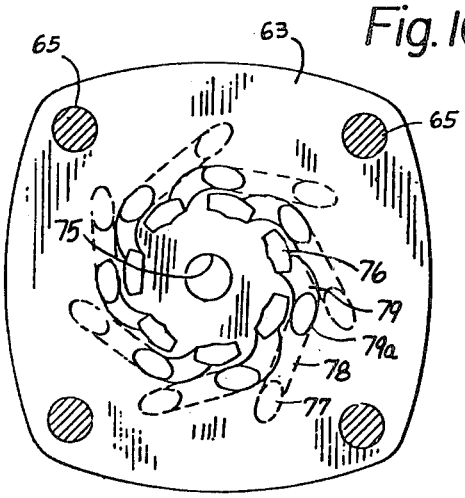
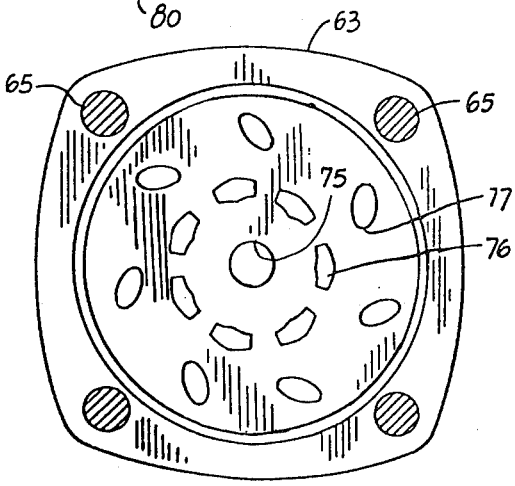
Fig. 11

ROTARY GEROTOR HYDRAULIC DEVICE WITH FLUID CONTROL PASSAGEWAYS THROUGH THE ROTOR

This is a continuation-in-part of application Ser. No. 113,400, filed Jan. 18, 1980, now U.S. Pat. No. 4,357,133, which is a continuation of application Ser. No. 910,057, filed May 26, 1978, now abandoned.

SPECIFICATION

An object of this invention is to provide a rotary fluid pressure device including a gerotor having a fixed stator inside of which is an orbiting and rotating rotor. The rotation of the orbiting rotor member provides the output or input at the shaft member. This rotor has a continuous ring valve on one side and both of the supplies of intake and exhaust pressure fluid are on the opposite side. A star-pointed annulus increases commutation fluid flow. The second embodiment shows again a fixed stator with an orbiting rotor with the rotating component of the rotor used at the output shaft; but in this embodiment the intake is on the internal diameter of one side of the rotor member with balanced area grooves in communication with the first named intake and exhaust grooves on the opposite side of the rotor so as to provide a hydraulically balanced rotor.

An added object of this invention is to provide a pressure loaded commutator ring urged with a wave spring for initial contact, together with a drive pin connected between the rotor and the commutator ring.

Another object of the invention is to provide a pressure loading plate in the end cover of the housing so as to cause a pressure balance providing a head force towards the manifold and gerotor set.

The present invention reduces the number of manufacturing operations necessary to make hydraulic pressure devices. The devices made in accord with this invention are simple, reliable and efficient.

Another object of this invention is to provide a hydraulically balanced rotor.

Still another object is to reduce the wear of and cool the wobble stick drive connections.

Another object of the invention is to increase the commutation fluid flow.

Other objects and advantages of the present invention will be apparent from the accompanying drawings and the description. The essential features will be set forth in the appended claims.

BRIEF DESCRIPTION OF THE DRAWINGS

FIG. 8 is a central sectional view through the second embodiment of this invention;

FIGS. 9, 10 and 11 are respectively sectional views taken along the lines 9—9, 10—10 and 11—11 of FIG. 8;

FIG. 12 is a fragmental sectional view taken at the righthand end of FIG. 1 and showing a pressure loaded commutator ring; while

DESCRIPTION OF PREFERRED EMBODIMENT

Those familiar with this type of apparatus will understand that while the present invention is being described as a pump using a fluid inlet and a fluid outlet, nevertheless, the same structure may be used as a motor by merely reversing the fluid inlet and outlet so that the high pressure fluid now enters at what was previously the inlet and the device operates as a motor.

In the description and claims occurring hereinafter, the term "housing" is used to include not only the main housing member but also the pressure plate, gerotor set, manifold and end cap, all of these latter parts being connected to the main housing portion by bolts.

Figure 1:
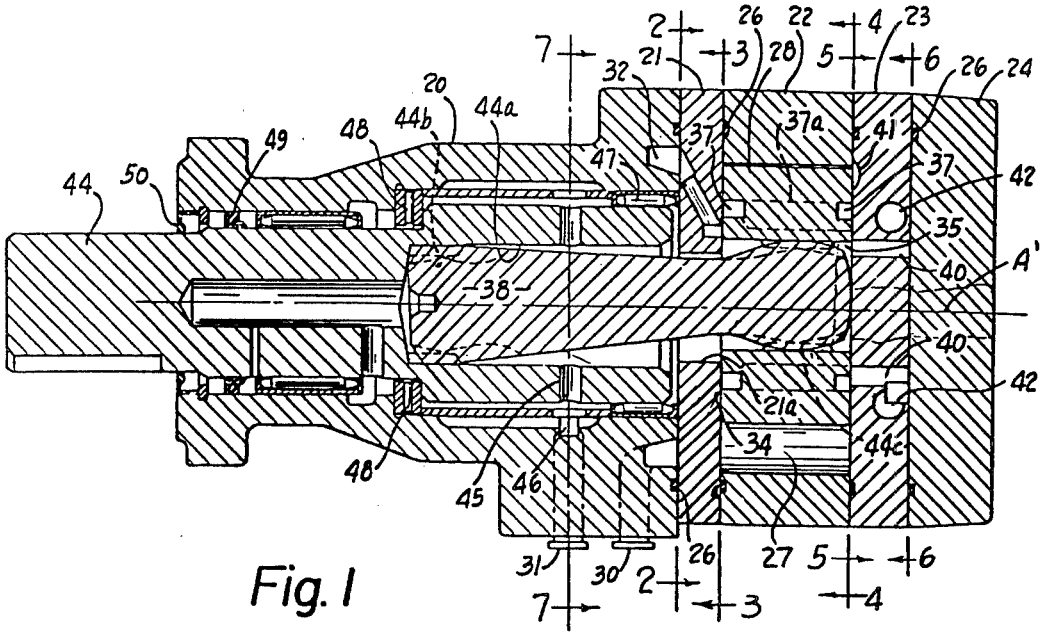
FIG. 1 is a central sectional view through the first embodiment of this invention.

Referring now to FIG. 1, the first embodiment of this invention comprises a main housing unit 20 having a radially flat inner end to which is respectively attached a wear plate 21, a gerotor set 22, a manifold 23 and an end cap 24, all of these being secured together by bolts 25, which are shown in the various sectional views but omitted from FIG. 1, but those skilled in this art will recognize that the bolts have heads pressing against the outer righthand end of the end cap 24 and extending through the members 21, 22 and 23 and threaded tightly into the main housing portion 20. Sealing rings 26 seal all of the members against leakage between them.

Figure 4:
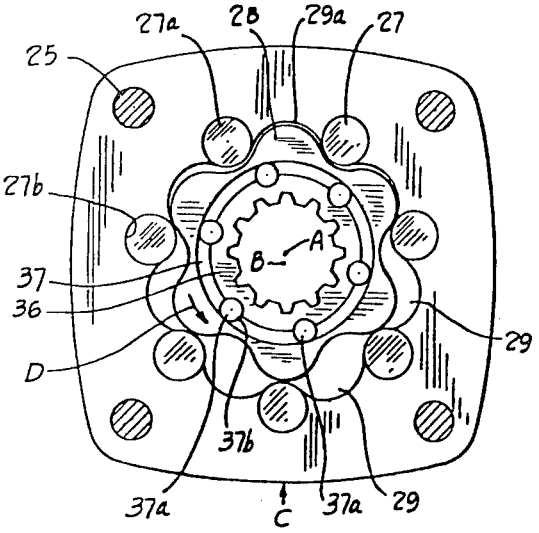
FIG. 4 is a sectional view taken along the line 4—4 of FIG. 1.

The gerotor set 22, best seen in FIGS. 1 and 4, comprises an internal toothed member 27 which is a stator inside of which a coacting externally toothed member 28, a rotor, which rotates about its own axis A as seen in FIG. 4, but which is eccentric relative to the center of the stator 27 by the distance shown between A and B, on the line of eccentricity C, and the rotor orbits about the center B. During this movement of the rotor and stator a series of cells 29 and **29*a* form a series of cells of constantly changing size between the rotor and stator, the size of the cells becoming greater on one side of the line of eccentricity, and the cell size becoming smaller on the opposite side. In FIG. 4 the minimum size cell at 29*a* approaches zero. The rotor rotates in the direction of the arrow shown in FIG. 4**. The rotor has two flat axial end surfaces.

The inlet means to the housing is indicated at 30. The fluid outlet means is shown at 31. The inlet means is connected by means indicated only in dot-dash lines through a continuous annulus or distribution channel 32 in the main housing portion 20. This annulus opens through the wear plate 21 which has a number of through openings or fluid travelways 33, the number of which is not important, but sufficient to take care of the flow of fluid necessary. These openings 33 are connected by connecting passages **33*a* to the annulus or annular ring transfer channel 34 of smaller diameter on the opposite face of the wear plate and opening into the rotor cavity toward the gerotor 22**.

Figure 14:
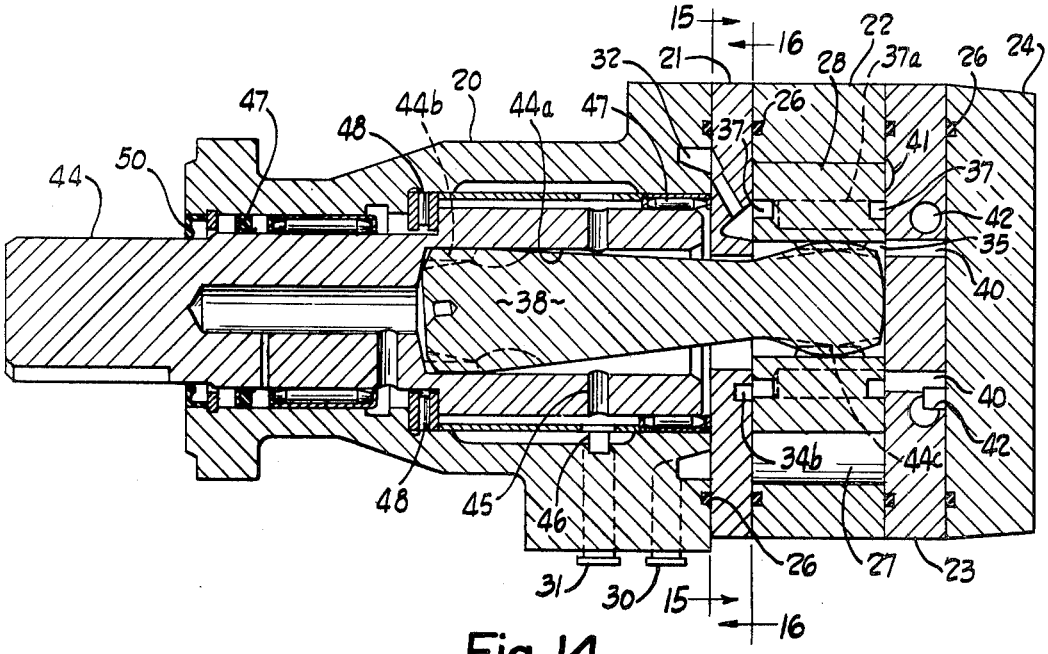
FIG. 14 is a central sectional view like FIG. 1 but including a star pointed annulus.
Figure 15:
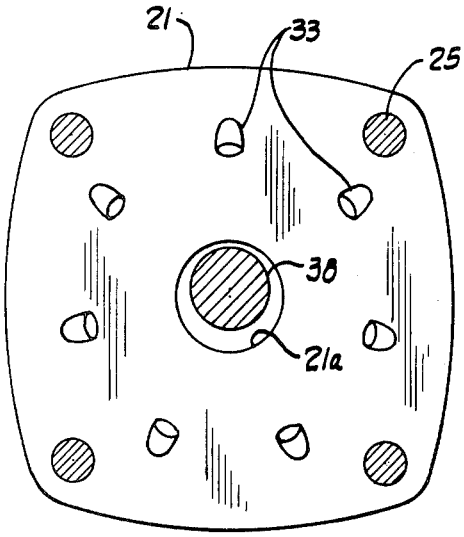
FIG. 15 is a sectional view taken along line 15—15 in FIG. 14.
Figure 16:
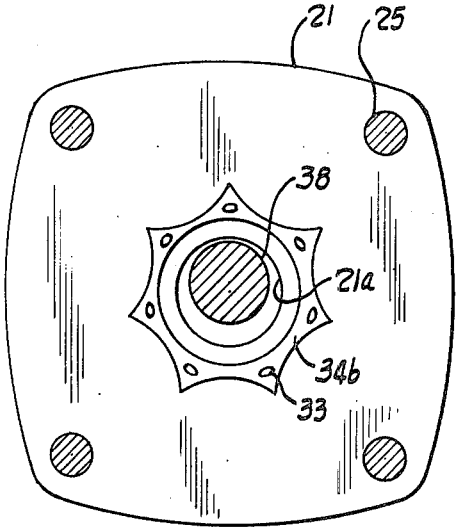
FIG. 16 is a sectional view taken along line 16—16 in FIG. 14.

The annulus 34 may be ring-shaped (FIGS. 1 and 3) or star-pointed (FIGS. 14 and 16). The ring-shaped annulus 34 is symmetrical—a channel of uniform diameter and depth. The starpointed annulus **34*b*, in contrast, has a shape dictated by the area swept by the passageways 37 through the rotor 28 during the rotation of the rotor 28. The star-pointed annulus 34*b* is of varying diameter and depth—widest and deepest at the points of the annulus 34*b*. The connecting passages 33*a* intersect with the star-pointed annulus 34*b* at the points of the annulus 34*b***.

The internal teeth **27*a* on the stator 27 are provided by cylinders 27*a* inserted in recesses 27*b* over 180° in circumference so as to maintain the cylinders 27*a* in the positions shown in FIG. 4. It will be understood that the cylinders 27*a* terminate at the level of the opposite faces of the stator 27. The rotor 28 has external teeth which are formed to fit almost exactly between the internal teeth of the stator, as shown in FIG. 4. The rotor 28 has an open center 35 surrounded by a sealing strip 36 which is uninterrupted circumferentially and laterally outside of which is an annular liquid intake passageway 37. The axis of rotation for the wobble stick 38 is marked A′ in FIG. 4. The axis of rotation for the orbiting movement of the wobble stick 38 relative to the stator is indicated at B in FIG. 4. The line C passing through A and B is herein indicated as the line of eccentricity. The movement of the rotor herein described is as indicated by the arrow D in FIG. 4. During this rotation the cells 29 on the lefthand side of the line of eccentricity increase in size gradually while the cells 29 on the righthand side of the line of eccentricity gradually decrease in size as indicated in FIG. 4. The rotor functions as the main valve for the device. Six travel passageways or holes 37*a* are evenly spaced around the annulus 37 extending linearly through the rotor parallel to the axis of the rotor. These project radially inwardly from the annulus or annular channels 37 as seen at 37*b*, in one embodiment this being about ⅛ of an inch projection. The other travel passageway is generally on the central axis of the rotor, in the structure disclosed around the wobble stick-rotor device connection. There are sufficient openings in this type of drive connection that fluid flow is relatively unimpeded by the spline-gear interfaces. The transfer channel 34** communicates with the annular channel as the device is operated.

Figure 5:
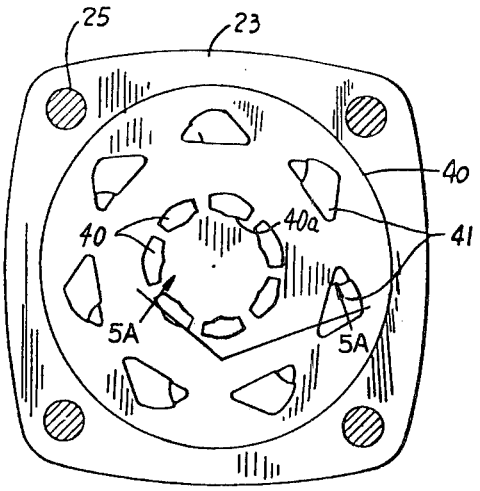
FIG. 5 is a sectional view taken along the line 5—5 of FIG. 1.
Figure 5A:
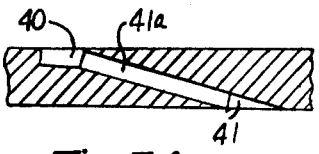
FIG. 5A is a fragmental sectional view taken along the line 5A—5A of FIG. 5.
Figure 6:
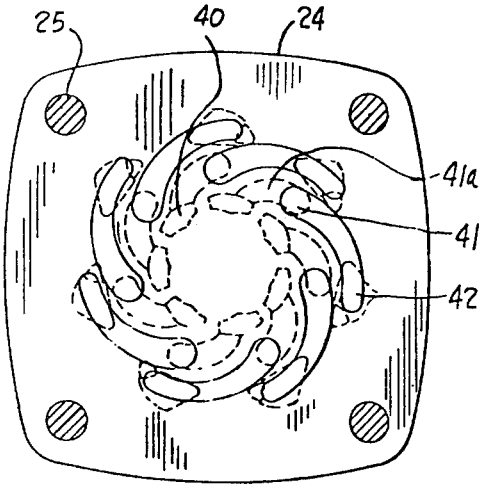
FIG. 6 is a sectional view taken along the line 6—6 of FIG. 1.
Figure 7:
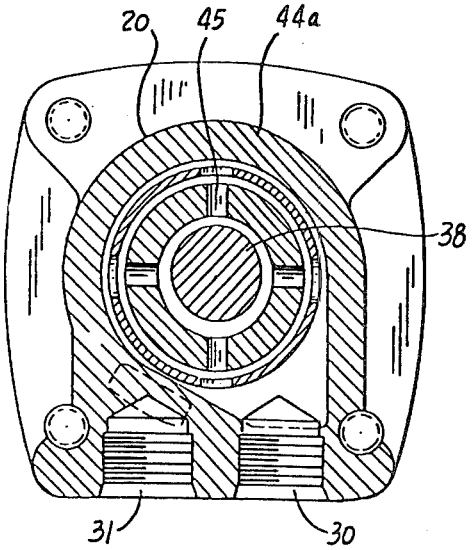
FIG. 7 is a sectional view taken along the line 7—7 of FIG. 1.

A manifold 23 connects the rotor valve with the gerotor cells. The manifold 23 will be best shown in FIGS. 5, 5A, and 6. Seven parallel through openings to extend through rotor facing surface of the manifold 23 parallel to its axis. This set of openings, as best seen in FIGS. 5 and 6, have a peculiar cross section. These openings 40 will be herein described as "double-trapezoidal". Referring to FIG. 5, it will be seen that one of these openings appears substantially like two trapezoids facing each other with no middle partition and having opposite ends which are not quite parallel but instead are radial. The radially inner side of each opening is composed, not of straight lines, but of lines slightly concave inwardly meeting in a slight peak at the center **40*a*. The outer wall of this opening radially, as seen in FIG. 5, may be composed of two straight lines meeting in the center or preferably a single line slightly convex radially outwardly. The size of each of these openings is such as to fit in the opening, seen in FIG. 4, between two of the cylindrical openings 37*a* in a circumferential direction and between the central opening and the annulus 37 in a radial direction. These openings 40 are swept by the travel passageways in the rotor as the device is operated. This performs the primary valving function of the device. Each of the openings 41, as seen in FIGS. 5 and 6, of which there are seven evenly spaced, on the side of the manifold toward the gerotor are connected by fluid passageways 41*a* and 42 sloping inwardly and downwardly to one of the openings 40** just described.

The manifold 23, as seen in FIG. 6, shows seven inclined passageways 42 in solid lines which coact with the structure described in connection with the openings 41, passageways **41*a* and openings 40 as previously described. These coacting passageways are shown in broken lines in FIG. 6 to show the cooperation. Seven of such passages 42 are provided extending part way through the manifold from side to side. These are at a slight angle to the axis of the gerotor and are spaced at a diameter to register, as shown in FIGS. 5 and 6. It will thus be seen that each passageway 42 in the manifold mates with one of the passages 41*a* half way through the manifold so that each of the seven passages 40 combines with one of the passages 41***a*, 42.

Figure 2:
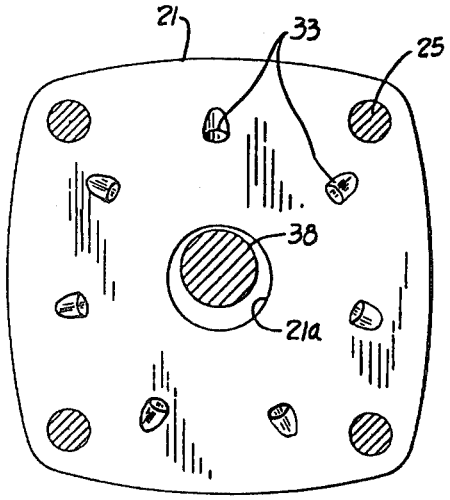
FIG. 2 is a sectional view taken along the line 2—2 of FIG. 1.
Figure 3:
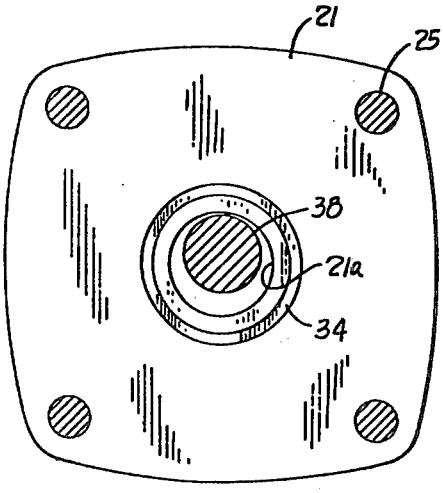
FIG. 3 is a sectional line taken along the line 3—3 of FIG. 1.

The elongated rigid wobble stick 38 is clearly seen in FIG. 1 and shown in section in FIGS. 2 and 3. One end of the wobble stick has a spline connection 44*b* with the drive shaft 44. It will be noted that this shaft has a solid outer end and a hollow inner end as indicated at 44*a*. The opposite end of the wobble stick has a spline connection 44*c* in a central bore in the rotor 28. These spline connections are provided in such a manner that the wobble stick may rotate and orbit around the center axes A, B, and that fluid can continuously flow over and around them. The exhaust passageway includes the open center 35 of the rotor over and around the wobble stick-rotor drive connection and the open center 21*a* of the wear plate and the hollow 44*a* and is completed by four radial passageways 45 and 46 which are connected, as shown in dot-dash lines, with the outlet 31.

Suitable needle bearings are shown at 47 and 48 supporting the drive shaft 44 in the main housing portion 20. Also suitable sealing means as shown at 49 and 50 are provided where the drive shaft passes out of the main housing portion 20.

This embodiment has been described as a pump utilizing the drive shaft 44 for the attachment of power which would cause intake of lower pressure fluid at 30 and exhaust of higher pressure fluid at 31. As previously explained, reversing the connections 30 and 31 will cause the device to operate as a motor producing power on the drive shaft 44.

The operation of the first embodiment as a pump will now be described. Power is supplied to the protruding left end of the drive shaft 44 as seen in FIG. 1. This rotates the shaft, the wobble stick 38, the rotor 28, and also causes the rotor to orbit about the stator 27. This causes the cells 29 to the left of the line of eccentricity C to gradually increase in size causing a suction at the intake 30. The cells 29 on the righthand side of the line of eccentricity C in FIG. 4 are also caused to progressively decrease in size thus causing the fluid under increased pressure to exhaust at the outlet 31. The incoming fluid from intake 30 passes through the annular channel 32, the passageways 33*a* to the annular channel 34, then through the rotor 28 through the annular channels 37 and the cylindrical holes 37*a*, then through the double trapezoidal openings 40 in the manifold 23, then through the passageways 41*a* and 42 in the manifold and through the openings 41 in the manifold and rotor and thus into the expanding cells 29. Other cells 29 are exhausted back through other openings 41 and other passageways 42 and 41*a* and other double trapezoidal openings 40 in the manifold into the open center 35 of the rotor. The fluid then flows over and around clearances in the wobble stick-rotor drive connection, cooling and lubricating it, through the opening 21*a*, through the hollow portion 44*a* of the shaft and through openings 45 and 46 and thus out through the outlet 31.

If the rotary fluid pressure gerotor device incorporates the star-pointed annulus 34*b* the commutation fluid passage is more direct and less constrained that with a ring-shaped annulus 34. Please note that other commutation channels in the gerotor device can also benefit from being star-pointed—for example annular channel 37.

The second embodiment of this invention is shown in FIGS. 8, 9, 10 and 11. FIG. 8 is a central sectional view through the second embodiment with the bearings and seals resembling those seen in FIG. 1 omitted for simplification of the drawings.

The main housing portion 60 has secured to it a wear plate 61, a gerotor set 62, a manifold 63 and an end cap 64, all secured rigidly together by a plurality of bolts 65 extending from the righthand end of the device as seen in FIG. 8 into threads in the main housing portion 60. The main housing portion has an air intake 66 connected by a passage 67 through the housing portion 60 with a continuous annulus chamber 68, which communicates with a plurality of radial openings 69 which lead inwardly to a hollow portion 70*a* of a drive shaft 70 which is rotatably mounted in the housing portion 60. An elongated rigid wobble stick 71 has a spline connection 71*a* at one end with the drive shaft 70 and another spline connection 71*b* at the opposite end with the rotor member of the gerotor set 62. The spline connections 71*a* and 71*b* are so shaped as to permit the rotation of the wobble stick while at the same time permitting it to follow the orbiting movement of the rotor in the stator as will presently appear.

The wear plate 61 has a circular opening 61*a* which permits the necessary movement of the wobble stick 71 and at the same time forms part of the intake passageway for fluid.

Six pairs of intake passageways 82 and 83 extending through the rotor 72 connecting the circular opening 61*a* in the wear plate 61 with the annular passageway 84. The annular passageway 84 opens towards the manifold 63.

Figure 17:
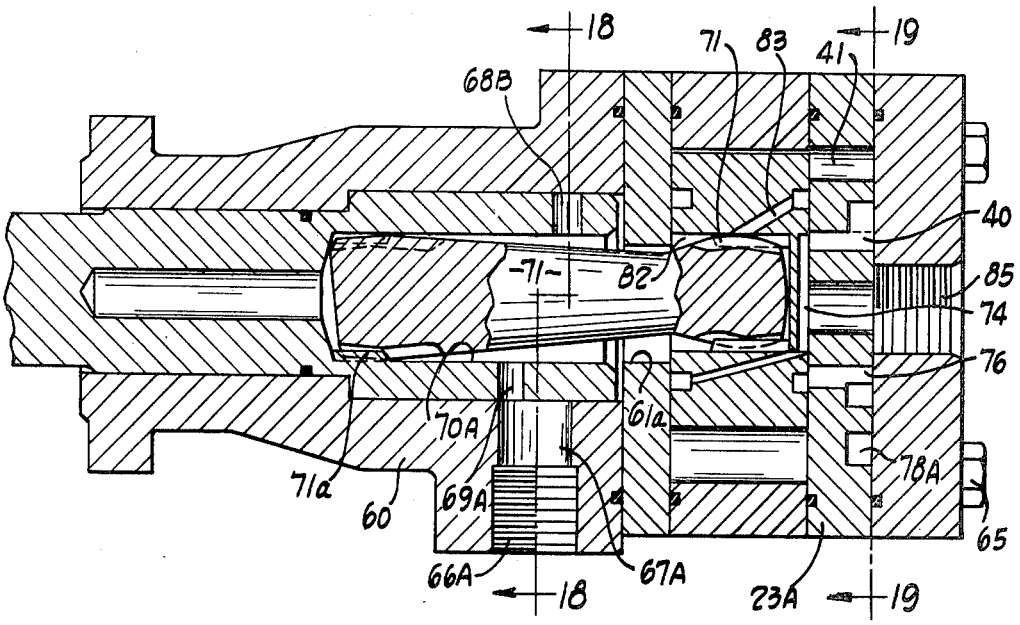
FIG. 17 is a central sectional view of a hydraulic device like FIG. 8 having shortened through passage and differing manifold passages.

FIG. 17 is of a device like that shown in FIG. 8. In the device of FIG. 17 the intake passageway 83 terminates in the area of the spline drive connection 71. This cools and lubricates this connection. In addition the manifold plate 23A uses surface channels 78A to connect the openings 40 and 41, respectively.

Figure 18:
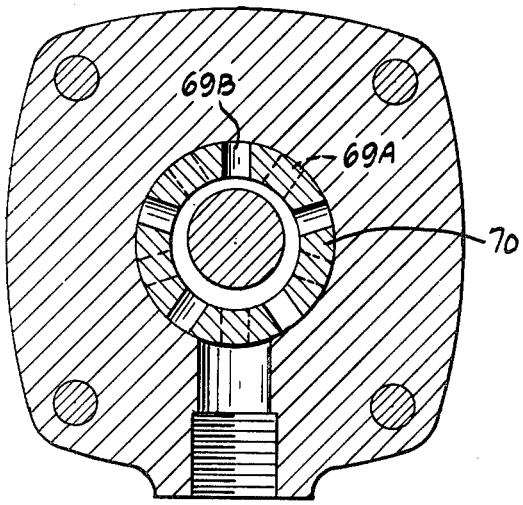
FIG. 18 is a sectional view of the hydraulic device of FIG. 17 taken along lines 18—18 of that FIGURE.

The intake 66A and passage 67A are of a greater diameter than in FIG. 8. There are two staggered rows of radial openings 69A, 69B, in the drive shaft 70. See FIG. 18. These in combination allow for the unimpeded fluid input into the area about the wobble stick without the need of a continuous annulus chamber 68 as in FIG. 8.

Figure 19:
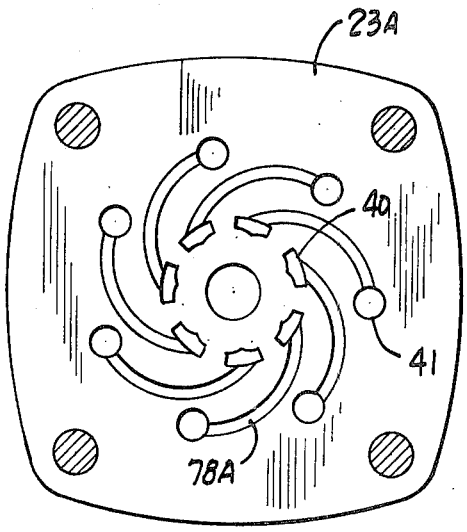
FIG. 19 is a sectional view of the manifold plate of FIG. 17 taken generally along lines 19—19 of that FIGURE.

The manifold plate 23A, instead of using angled holes 78 to connect the pairs of openings 40–41 respectively, uses channels 78A let into the surface of the manifold plate 23A away from the rotor. See FIG. 19. The end plate covers the open side of the channels 78A. See FIG. 17.

The gerotor 62 is best seen in FIG. 9. It comprises a stator 62*a* which has a plurality of internally extending teeth formed partly by direct formation in the stator but also in part by six cylindrical members 62*b* which are firmly held in recesses 62*c* which extend for a distance greater than the diameter of each of the cylinders 62*b* so that they are held firmly in the position shown in FIG. 9. A rotor 72 is shown having a plurality of externally extending teeth 72*a* which are shaped to fittingly coact with the internally extending teeth 62, 62*a* and 62*b*, these external teeth being one less in number than the internal teeth previously described. The rotor has an axis E which is eccentric relative to the axis F of the stator and the line G passing through points E and F is herein designated as the line of eccentricity. The rotor is provided with a generally annular ring 73 forming part of the intake passageway for fluid. This passageway is concentric around the axis E. Inside the annular ring 73 is a circular opening 74, also concentric, for the exhaust of fluid from the rotary fluid pressure device.

Referring now to FIGS. 9, 10 and 11, FIG. 11 shows the face of the manifold toward the gerotor structure 62. Centrally there is the exhaust opening 75 which communicates with the exhaust opening 74. In the next circle, and concentric, are seven rotor communicating openings 76, and in an outer concentric circle are seven passageway openings 77 so positioned that they cooperate circumferentially with the cells 80 which are formed in changing fashion between the rotor and the stator as seen in FIG. 9.

FIG. 10 shows the face of the manifold 63 toward the end cap 64. This shows the through passageways 76 each connected to one of the openings 77 by means of angular passageways 78 and 79, each pair of which joins at an opening 79*a*.

The cooperation of these parts is shown in dot-dash lines in FIG. 9 at 81. This shows one of the openings 77 in position to cooperate with a cell 80*a* at the top of FIG. 9 and it is in cooperation through passageways 78 and 79, here shown diagrammatically, with one of the openings 76, which you might say is about two and one-half positions away going around the circle. It will now be seen how the radially outward openings 84*a* in the annular ring 84 cooperate with the communicating passageways 76. There are six of the formations 84*a* and each comprises a central, radially outermost portion 84*b* which extends substantially circumferentially and at each end of this outermost portion is a radially and circumferentially inwardly sloping portion 84*c* which extends to a radially innermost separating portion 84*d*. Each of the passageways 76 is herein described as double trapezoidal in section inasmuch as the opposite halves of the section are approximately trapezoid with their wider edges opening toward each other in the center. It will now be seen in FIG. 9 that when the dead pocket 80*a* at the top of FIG. 9 is in communication with its associated opening 77, then the other end of the connection through the 78, 79 connection and shown at 76 in dot-dash lines will illustrate how the exhaust pocket related to cell 80*a* is shut off before the fluid is transferred from the associated intake pocket 76. This gives the dead center pocket a higher pressure than the supply at 66 because the fluid is trapped at that particular moment. This higher pressure causes the rotor 72 to seal better against the cylindrical members 62*b* on the opposite side of the axis. This higher pressure in cell 80*a* also provides oil to the pivot roll near the upper dead center in FIG. 9 whereby the rotor floats on a hydrodynamic oil film thus giving a higher mechanical efficiency output. It will now be seen that the shape of each of the portions 84*a* of the annular ring 84 match fairly well with the radially outer edges of the double trapezoidal passageways 76.

A balancing ring 86 is on the opposite side of the rotor from the annular ring 84. Small passages 87 through the rotor connect the balancing ring 86 to the opening 74. The balancing ring 86 equalizes the hydraulic pressure on the rotor 72.

It should now be apparent how the operation of this device as shown in FIGS. 8–11 operates. Power is applied to the shaft 70 causing the rotor 72 to rotate in the stator 62*a* in the direction of the arrow shown in FIG. 9. The intake flow is from the inlet 66 through passageways 67 and 68, then through the hollow shaft portion 70*a* and through the central opening 61*a* in the wear plate. Then the flow is through passageways 82 and 83 to the annular passageway 84 which opens toward the manifold 63. Then the flow passes through an opening to passageway 76 on one side of the eccentricity line G through the manifold passages 78, 79 to one of the openings 77 which is in communication with one of the cells 80 between the rotor and stator. Meanwhile, one of the cells 80 on the other side of the eccentricity line G communicates back to the appropriate passageway 76 and back through the manifold 63 to the exhaust passageways 74, 75 and 85 to exhaust.

Figure 12:
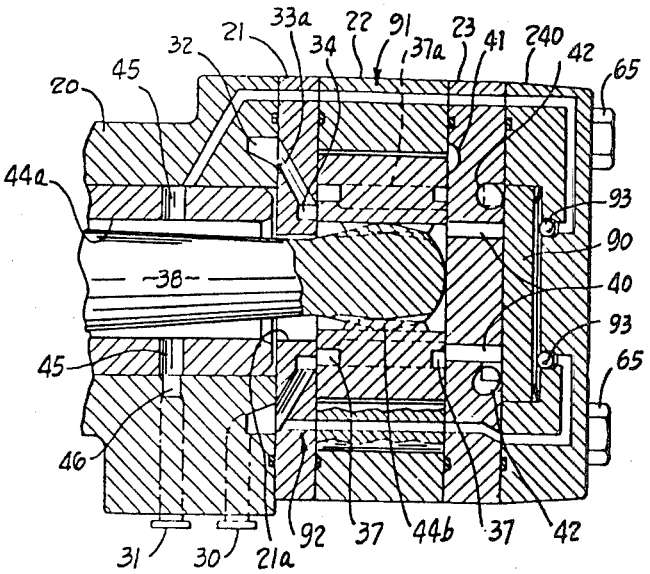

FIG. 12 shows a portion of the righthand end of FIG. 1 where the same parts are given the same reference numbers. Otherwise, the device operates as described in connection with FIG. 1. However, in FIG. 12 there has been added a pressure plate 90 inserted in a suitable recess in the end cap 240, and the end cap is pushed toward the left as viewed in FIG. 12 by means of pressure admitted through lines 91, connected with the exhaust 45, and line 92 connected with the intake 30. Each of the lines 91 and 92 has adjacent the pressure loading plate 90 a ball check valve 93 so that the loading plate 90 is always pressed inwardly toward the manifold 23 and the gerotor set 22 beyond it. This provides a head force towards the manifold and rotor set. This will take care of any wear between the engaging rubbing portions 22 and 23.

Figure 13:
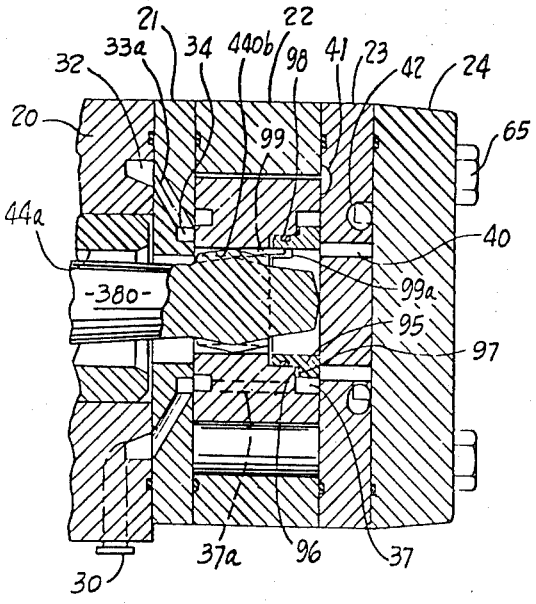
FIG. 13 is a fragmental sectional view taken at the righthand end of FIG. 1 and showing a pressure loading plate in the end cover.

FIG. 13 also shows a portion of the righthand end of FIG. 1 and all of the same parts are given the same reference characters. The added feature here is a pressure loaded commutator ring 95 which extends inwardly, toward the left in FIG. 13, against a shoulder 96 with a wave spring 97 circular in shape and pressed between the commutator ring and the shoulder 96 to give an initial pressure. The wave spring is made of spring metal which weaves back and forth from a generally common plane as one goes around the circle. A seal 98 prevents leakage between the parts. There is provided a pin connection 99 which as seen in FIG. 13 is in general an axial extension of the splines 440*b* connecting the wobble stick 380 and the rotor of the gerotor set 22. This pin fits between the splines 440*b* and extends into a suitable opening 99*a* in a portion of the commutator ring. This pin connection is somewhat loose so as to use the rotational component of the rotor as a means of timing the opening and closing of the connection indicated in dot-dash lines in FIG. 9.

Figure 20:
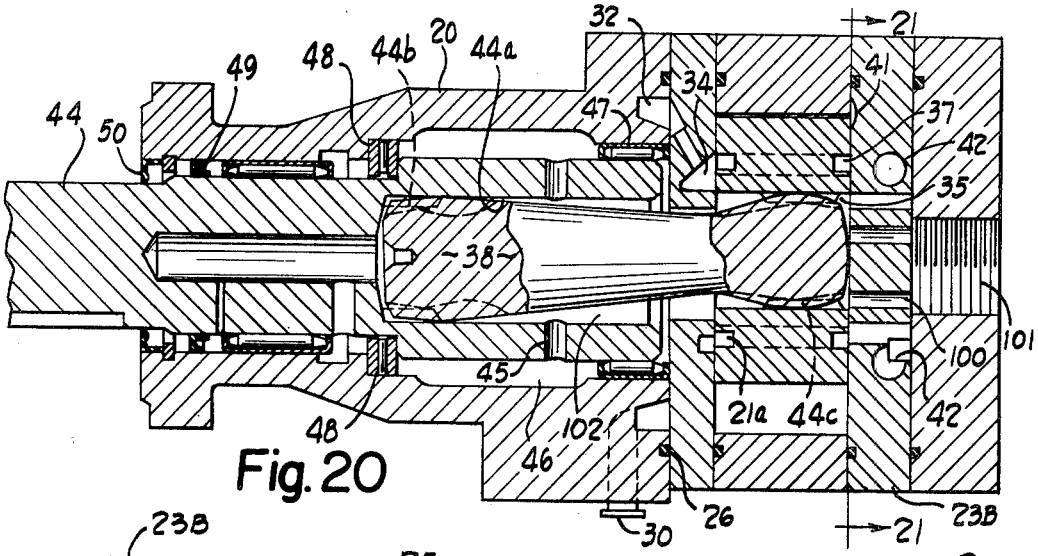
FIG. 20 is a central sectional view like FIG. 14 of a bilateral ported hydraulic device.

FIG. 20 is of a bilateral ported hydraulic device. In this device the inner travel passageway instead of running through the open center 35 of the rotor doubles back through a series of holes 100 in the manifold plate 23B to exit the gerotor device through port 101.

Figure 21:
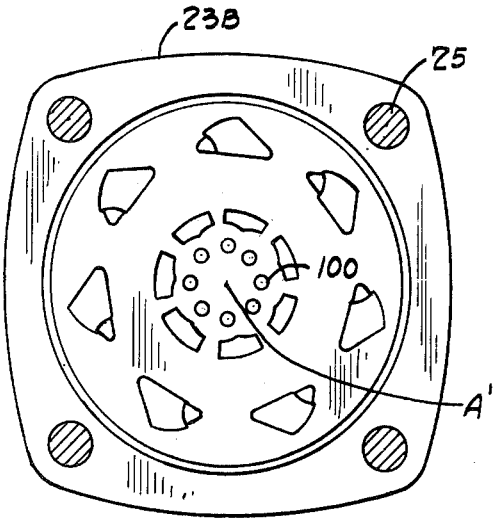
FIG. 21 is a sectional view of the manifold plate of the bilateral ported hydraulic device of FIG. 20 taken generally along lines 21—21 of that FIGURE.

The holes 100 extend through the manifold plate 23B about the central axis A′ of the gerotor device. The wobble stick 38 makes any physical contact that it does with the manifold plate 23B in the center of the circle defined by holes 100. See FIG. 21.

Due to the pressures and volumes of fluid in motion in the gerotor device there is a constant back water type fluid flow at all times over the wobble stick 38—rotor drive connection 44*c* and throughout the central cavity 102 of the gerotor device. This fluid lubricates and removes contaminants from the gerotor device.

Figure 23:
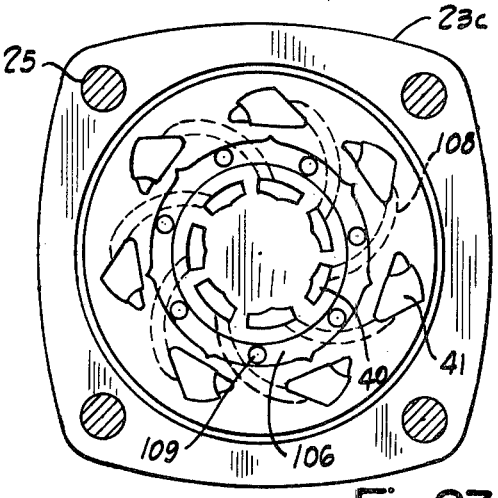
FIG. 23 is a sectional view of the manifold plate of the inverse valved hydraulic device of FIG. 22 taken generally along lines 23—23 of that FIGURE.
Figure 22:
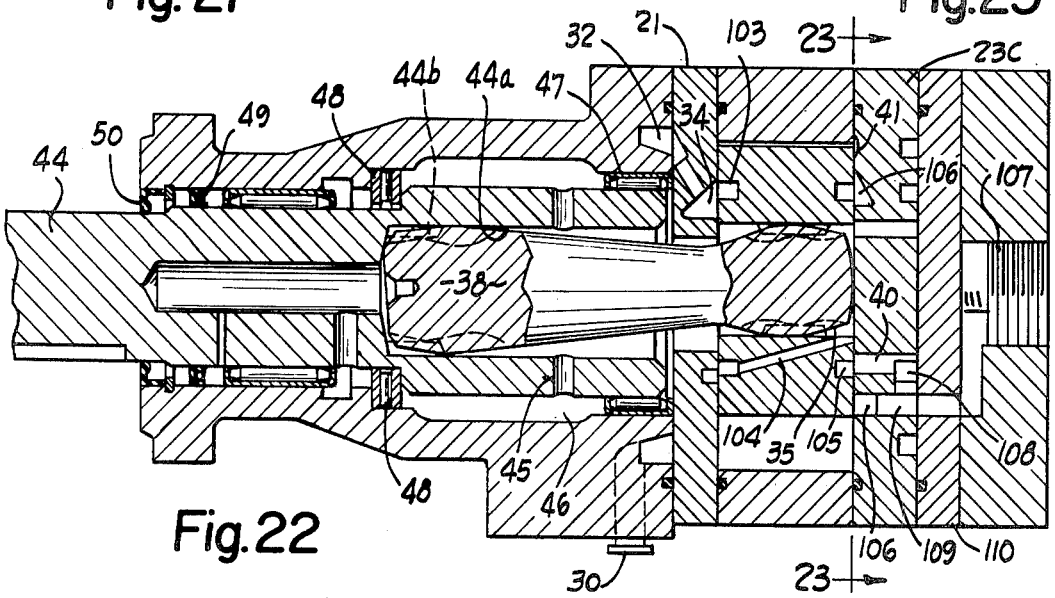
FIG. 22 is a central sectional view like FIG. 8 of an inverse valved hydraulic device.

FIG. 22 is of an inverse valved hydraulic device. In this inverse valved device an outer ring channel 103 on one side of the rotor 28A connects through a diagonal passageway 104 to the open center 35 of the rotor. A star shaped annulus 34 communicating with the outer ring channel 103 connects the fluid passage to one of the fluid ports 30. The other fluid passage is a second ring channel 105. Another star-shaped annulus 106 communicating with the second ring channel 105 connects this fluid passage to the other of the fluid ports 107. This annulus 106 is on the manifold plate 23C between openings 40 and 41. See FIG. 23. (These openings 40 and 41 are connected together respectively by a series of channels 108 on the opposite side of the manifold plate 23C.) A series of holes 109, the location of which is not critical, extend from the annulus 106 through the manifold plate 23C and through the channel closure plate 110 to connect with cavity 111. The port 107 is connected to the cavity 111.

In operation the open center 35 of the rotor and the second ring channel 105 selectively communicate with the manifold openings 40 to valve the gerotor device.

Figure 24:
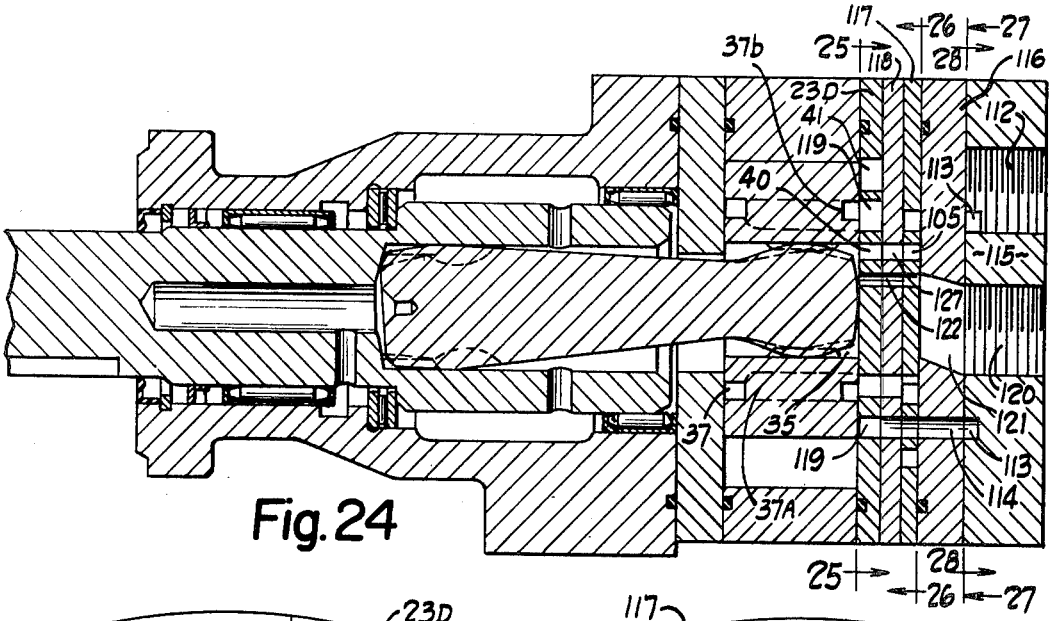
FIG. 24 is a central sectional view like FIG. 14 of a manifold plate ported hydraulic device.
Figure 25:
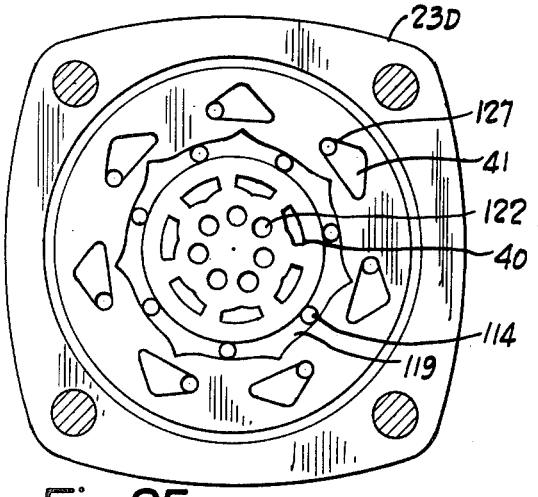
FIG. 25 is a sectional view of the manifold plate of FIG. 24 taken generally along lines 25—25 of that FIGURE.
Figure 26:
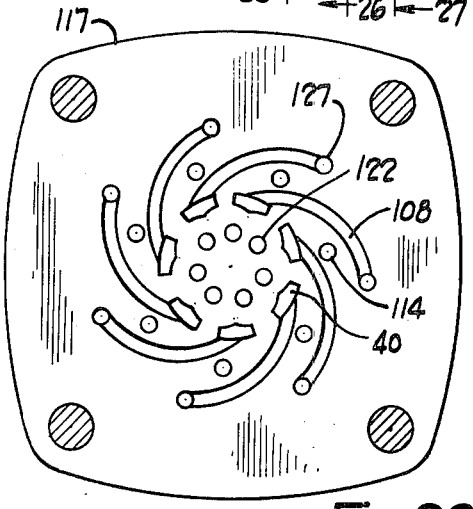
FIG. 26 is a sectional view of the manifold plate of FIG. 24 taken generally along lines 26—26 of that FIGURE.
Figure 27:
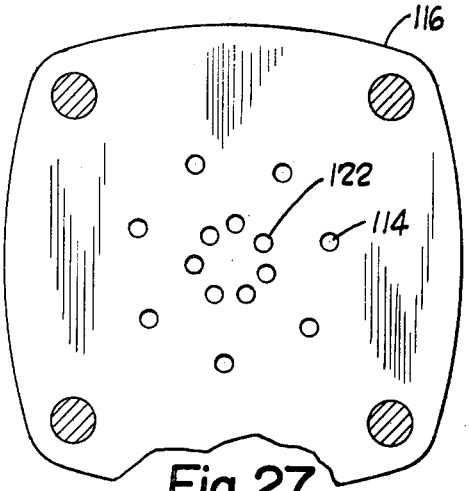
FIG. 27 is a sectional view of the channel closure plate of FIG. 24 taken generally along lines 27—27 of that FIGURE.
Figure 28:
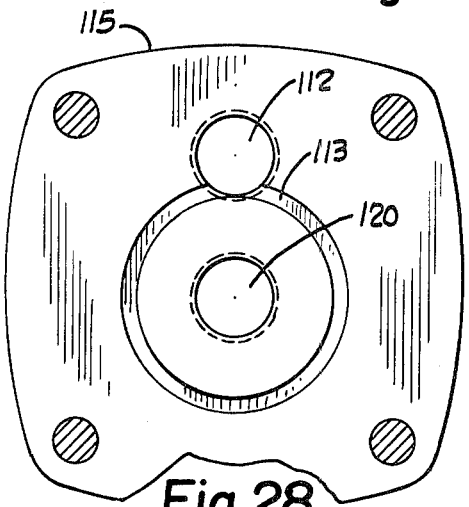
FIG. 28 is a sectional view of the end plate of FIG. 24 taken generally along lines 28—28 of that FIGURE.

FIG. 24 is of a manifold plate ported hydraulic device. In this device both the porting commutation and the valving occur between a single surface of the rotor and the manifold plate 23D.

In this device port 112 connects through ring channel 113 in the end plate 115, and holes 114 through the closure plate 116, median plates 117, 118 and manifold plate 23D to star-shaped commutation annulus 119. The annulus 119 communicates with ring channel 37B on the rotor. Port 120 connects through hole 121 in the closure plate 116 to the series of holes 122 in the median plates 117, 118 and the manifold plate 23D. The series of holes 122 communicate with the open center 35 of the rotor.

Passages 37A and the other ring channel 37 hydraulically balance the rotor for fluid pressure in the ring channel 37. The opposite end of the open center of the rotor hydraulically balances the open center fluid passage.

The manifold plate has openings 40 and 41. Openings 40 extend through the manifold plate. Holes 127 extend off of openings 41 through the manifold plate. Respective pairs of openings 40 and holes 127 are connected together by a series of channels 108 on the median plate 117.

In operation the ring channel 37 and the open center 35 of the rotor selectively communicate with openings 40 to valve the device.

The actual porting in the manifold ported hydraulic device of FIG. 24 is accomplished through the use of a series of successive plates 115–118 and 23D. Each of the plates is designed for ease of individual manufacture. See FIGS. 25–28. During assembly each plate is located in proper sequence in respect to the other plates to together form the porting passages of the device.

If necessary to insure an acceptable quantity of leakage between neighboring passages a sealing compound can be inserted between the plates, the plates after assembly may be brazed together to form a single unit or other appropriate steps taken.

Figure 29:
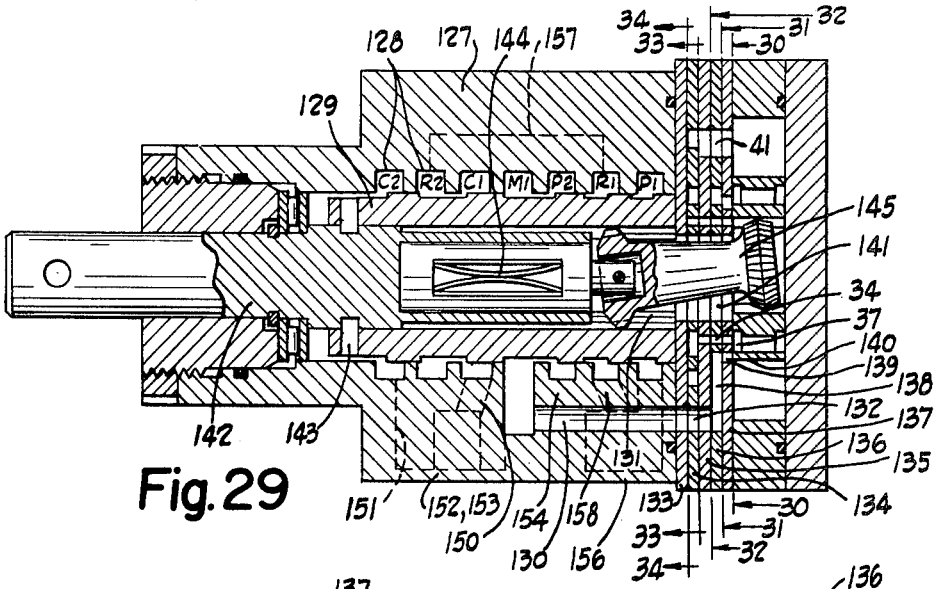
FIG. 29 is a central sectional view similar to FIG. 14 of an intermediate plate gerotor porting. The gerotor is contained in a power steering unit.
Figure 30:
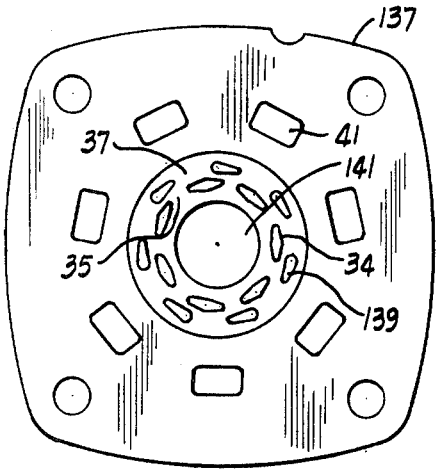
FIG. 30 is a view of the porting passages of FIG. 29 taken generally along lines 30—30 of that FIGURE.
Figure 31:
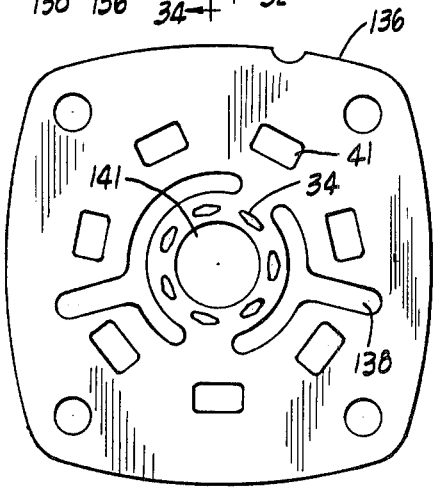
FIG. 31 is a view of the porting passages of FIG. 29 taken generally along lines 31—31 of that FIGURE.
Figure 32:
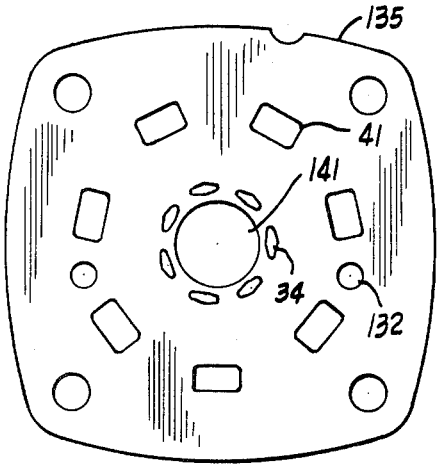
FIG. 32 is a view of the porting passages of FIG. 29 taken generally along lines 32—32 of that FIGURE.
Figure 33:
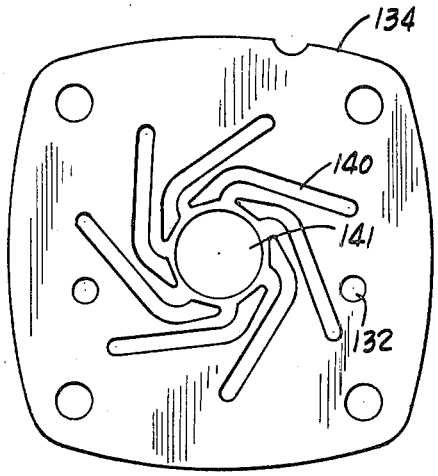
FIG. 33 is a view of the porting passages of FIG. 29 taken generally along lines 33—33 of that FIGURE.
Figure 34:
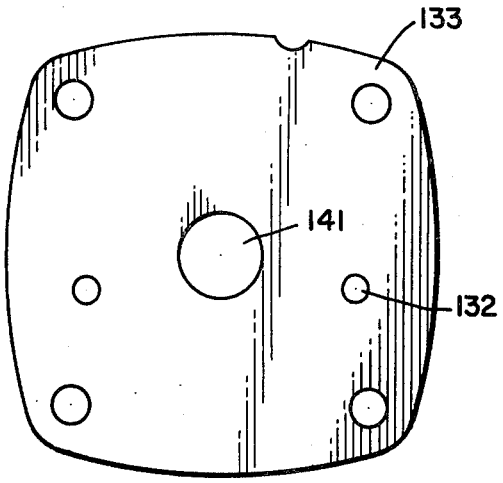
FIG. 34 is a view of the porting passages of FIG. 29 taken generally along lines 34—34 of that FIGURE.

FIG. 29 is of an intermediate plate ported hydraulic device. The device is disclosed in a power steering unit 127.

The fluid recesses 128 are arranged about the slide member 129 in a cylinder 2(C2), return 2(R2), cylinder 1(C1), media 1(M1), pressure 2(P2), return 1(R1) and pressure 1(P1) layout.

The cylinder 1(C1) and cylinder 2(C2) recesses are connected through passages in the power steering unit 127 and high pressure hydraulic hoses to opposing sides of a double acting hydraulic steering cylinder (all not shown). The pressure 1(P1) and pressure 2(P2) recesses are connected through passages in the power steering unit 127 and high pressure hydraulic hoses to the high pressure outlet of a hydraulic pump driven by an engine (all not shown). The return 1(R1) and return 2(R2) recesses are connected through passages in the power steering unit 127 and high pressure hydraulic hoses to the low pressure inlet of the hydraulic pump (all not shown).

The center passage 131of the power steering unit 127 communicates to the drive hole 141 and inner fluid passageway of the device. The media 1(M1) recess of the power steering unit 127 communicates to passage 130 and the outer fluid passageway of the device.

In operation the selective rotation of the input shaft 142 is transformed into axial movement of the slide member 129 through a pin-helical groove connection 143 within the limits of motion allowed by the torsion spring connection 144 to the wobble stick and thereafter into direct rotation of the wobble stick 145.

The axial movement of the slide member 129 interconnects the recesses 128 and passages 130–131 selectively. In the turning position shown in drawing 29 passage 130 is connected through the media 1(M1) recess to pressure 2(P2) and the center passage 131 of the device 127 is connected to cylinder 2.

The fluid from passage 130 travels through holes 132 in plates 133, 134 and 135 and the commutation passages 138 in plate 136 to the seven outer annulus holes 139 in plate 137.

From the outer holes 139 in the plate 137 the fluid communicates through annular channels 37 to some of the openings 34 that are located inside the outer holes 139. The openings 34 extend through plates 137, 136 and 135 to connect with the spiral passages 140 in plate 134, and through the spiral passages 140 to connect with openings 41, respectively. Openings 41 extend through plates 135, 136 and 137 to open into the gerotor cells of the device 127.

While the outer holes 139 are communicating by openings 34 to openings 41 leading to expanding gerotor cells, fluid from openings 41 leading contracting fluid cells communicates directly with the center passage 131 of the device through the drive hole 141 in the center of the rotor.

In an opposite turn the reverse would be true.

In this hydraulic device plates 133–137 are brazed together to form a single unitary structure.

Although this invention has been described in its preferred form with a certain degree of particularity, it is to be understood that the present disclosure of the preferred form has been made only by way of example and that numerous changes in the details and in the combination and arrangement of parts may be made without departing from the spirit and the scope of the invention as hereinafter claimed.

What is claimed is:

1. In a gerotor hydraulic pressure device having a housing, a rotor with a flat axial end surface rotatively engaging the housing at a plane, said rotor cooperating with said housing to define gerotor cells and two fluid connections, an improved fluid control comprising a pair of travel passageways, said pair of travel passageways being in the rotor, one of said pair of travel passageways surrounding the other of said pair of travel passageways, means at the plane to connect one of said pair of travel passageways to one of the fluid connections, means at the same plane to connect the other of said pair of travel passageways to the other of the fluid connections and means within the housing at the same plane to connect said pair of travel passageways to the gerotor cells selectively as the device is operated such that the commutation and valving of the device occurs on a single side of the rotor.

2. The gerotor hydraulic pressure device of claim 1 characterized by the addition of an input-output shaft and a wobble stick and wherein the plane of commutation and valving is on the same side of the rotor as the wobble-stick drive connection with the input-output shaft.

3. The gerotor hydraulic pressure device of claim 1 characterized by the addition of an input-output shaft and a wobble-stick and wherein the plane of commutation and valving is on the opposite side of the rotor as the wobble-stick drive connection with the input-output shaft.

4. In a gerotor hydraulic pressure device having a housing, a rotor with a flat axial end surface rotatively engaging the housing at a plane, gerotor cells and two fluid connections, an improved fluid control comprising a pair of travel passageways, said pair of travel passageways being in the rotor, means at the plane to connect one of said pair of travel passageways to one of the fluid connections, means at the same plane to connect the other of said pair of travel passageways to the other of the fluid connections and means within the housing at the same plane to connect said pair of travel passageways to the gerotor cells selectively as the device is operated such that the commutation and valving of the device occurs on a single side of the rotor.

5. The gerotor hydraulic pressure device of claim 4 characterized in that said means within the housing at the same plane to connect said pair of travel passageways to the gerotor cells is between said means at the plane to connect one of said pair of travel passageways to one of the fluid connections and said means within the housing at the same plane to connect the other of said pair of travel passageways to the other of the fluid connections.

6. In a gerotor hydraulic pressure device having a housing, a rotor with a flat axial end surface rotatively engaging the housing at a plane, said rotor cooperating with said housing to define gerotor cells and two fluid connections, an improved fluid control comprising the rotor having a center opening, means at the plane to connect said center opening to one of the two fluid connections, the rotor having a channel, said channel surrounding said center opening in the rotor, means at the plane to connect said channel to the other of the two fluid connections, and means within the housing at the same plane to connect said center opening and said channel to the gerotor cells selectively as the device is operated such that the commutation and valving of the device occur at one plane on a single side of the rotor.

7. The gerotor hydraulic pressure device of claim 6 characterized in that said means within the housing at the same plane to connect said center opening and said channel to the gerotor cells selectively as the device is operated is between said means at the plane to connect said center opening to one of the two fluid connections and said means at the plane to connect said channel to the other of the two fluid connections.

8. The gerotor hydraulic pressure device of claim 6 characterized by the addition of an input-output shaft and a wobble stick and wherein the plane of commutation and valving is on the same side of the rotor as the wobble stick drive connection with the input-output shaft.

9. In a gerotor hydraulic pressure device having a housing, a rotor with a flat axial end surface rotatively engaging the housing at a plane, said rotor cooperating with said housing to define gerotor cells and two fluid connections, an improved fluid control comprising the rotor having a center opening, means in the housing at the plane to connect said center opening to one of the two fluid connections, means to hydraulically balance the rotor for the forces present at said center opening, the rotor having a channel, said channel surrounding said center opening in the rotor, means in the housing at the plane to connect said channel to the other of the two fluid connections, means to hydraulically balance the rotor for the forces present at said channel, means within the housing at the same plane to connect said center opening and said channel to the gerotor cells selectively as the device is operated, and said means within the housing at the same plane to connect said center opening and said channel to the gerotor cells selectively as the device is operated being between said means in the housing at the plane to connect said center opening to one of the two fluid connections and said means in the housing at the plane to connect said channel to the other of the two fluid connections such that the commutation and valving of the device occurs at one plane on a single side of the rotor.

* * * * *